166-274 SR
FIP7512 OR 3,954,141

United States Patent [19]
Allen et al.

[11] 3,954,141
[45] May 4, 1976

[54] MULTIPLE SOLVENT HEAVY OIL RECOVERY METHOD

[75] Inventors: Joseph C. Allen, Bellaire; Charles D. Woodward, Houston; Alfred Brown, Houston; Ching H. Wu, Houston, all of Tex.

[73] Assignee: Texaco Inc., New York, N.Y.

[22] Filed: Feb. 3, 1975

[21] Appl. No.: 546,580

Related U.S. Application Data

[63] Continuation-in-part of Ser. No. 406,410, Oct. 15, 1973, abandoned.

[52] U.S. Cl. ..... 166/274; 166/305 R
[51] Int. Cl.[2] ..... E21B 43/16
[58] Field of Search ..... 166/269, 272, 273, 274, 166/303, 305 R

[56] References Cited

UNITED STATES PATENTS

| | | | |
|---|---|---|---|
| 2,718,262 | 9/1955 | Binder, Jr. | 166/274 |
| 2,822,872 | 2/1958 | Rzasa et al. | 166/273 |
| 2,880,801 | 4/1959 | Crump | 166/274 |
| 3,147,803 | 9/1964 | Reed et al. | 166/273 |
| 3,231,018 | 1/1966 | Handy | 166/274 |
| 3,354,958 | 11/1967 | Parker | 166/303 |
| 3,439,743 | 4/1969 | Wyllie | 166/273 |
| 3,608,638 | 9/1971 | Terwilliger | 166/272 |

*Primary Examiner*—Frank L. Abbott
*Assistant Examiner*—Jack E. Ebel
*Attorney, Agent, or Firm*—T. H. Whaley; C. G. Ries; Jack H. Park

[57] ABSTRACT

Petroleum may be recovered from viscous petroleum-containing formations including tar sand deposits by injecting into the formation a multiple-component solvent for the petroleum. At least one solvent component is gaseous at the temperature and pressure of the petroleum reservoir such as carbon dioxide, methane, ethane, propane, butane or pentane and at least one component is liquid at the reservoir conditions, such as hexane and higher molecular weight aliphatic or aromatic hydrocarbons. The multiple solvent is preferably introduced under sufficient pressure that it is substantially all in the liquid phase. Recovery of petroleum and solvent may be from the same well as is used for injection or from a remotely located well. When the pressure in a portion of the formation contacted by the solvents is reduced below the vapor pressure of the gaseous solvent, it vaporizes to provide drive energy for oil production. The liquid components dissolve in the petroleum and reduce the petroleum viscosity.

21 Claims, No Drawings

MULTIPLE SOLVENT HEAVY OIL RECOVERY METHOD

CROSS REFERENCE TO RELATED APPLICATIONS

This application is a continuation-in-part of our copending application Ser. No. 406,410 filed Oct. 15, 1973 and now abandoned.

BACKGROUND OF THE INVENTION

1. Field of the Invention

This invention is concerned with a method for recovery of petroleum from viscous petroleum-containing formations including tar sand deposits, and more particularly is concerned with an improved multiple-component solvent flooding technique especially useful in viscous petroleum-containing formations including tar sand deposits.

2. Description of the Prior Art

There are many subterranean petroleum-containing formations in various parts of the world from which petroleum cannot be recovered by conventional means because the petroleum is too viscous to flow or be pumped. The most extreme example of viscous petroleum-containing formations are the so-called tar sand or bituminous sand deposits. The largest and most famous such formation is the Athabasca Tar Sand Deposit in the northeastern part of the Province of Alberta, Canada, which contains over 700 billion barrels of petroleum. Other extensive deposits are known to exist in the western United States and Venezuela, and smaller deposits exist in Europe and Asia.

Tar sands are defined as sand saturated with a highly viscous crude petroleum material not recoverable in its natural state through a well by ordinary production methods. The petroleum constituent of tar sand deposits are highly bituminous in character. The sand present in tar sand deposits is generally fine quartz sand coated with a layer of water, with the bituminous petroleum material occupying most of the void space around the water wetted sand grains. The balance of the void space is filed with connate water, and some deposits contain small volumes of gas such as air or methane. The sand grains are packed to a void volume of about 35 percent, which corresponds to 83 percent by weight sand. The balance of the material is bitumen and water, and the sum of bitumen and water is fairly consistantly 17 percent by weight, with the bitumen portion thereof varying from about 2 percent to about 16 percent. One of the characteristics of tar sand deposits which differs considerably from conventional petroleum-containing formations is the absence of a consolidated material matrix within the formation. The sand grains are in contact although uncemented and the bitumen occupies most of the void space. The API gravity of the bitumen ranges from about 6 to about 8, and the specific gravity at 60°F is from about 1.006 to about 1.027. Generally around 50 percent of the bitumen is distillable without cracking. The bituminous petroleum from tar sand deposits is so viscous that some on-site refining of the produced petroleum must be undertaken if the material is to be pumped in an unheated pipeline.

The methods for recovering bituminous petroleum from tar sand deposits include strip mining and in situ separation processes. Most of the recovery to date has been by means of strip mining, although this is economically feasible only when the ratio of overburden thickness to tar sand deposit thickness is around 1 or less. Vast quantities of petroleum are known to exist in the form of tar sand deposits which are not within a range which is economically suitable for strip mining, and so there is a serious need for some form of in situ process wherein the bitumen or bituminous petroleum is separated from the sand by some means and recovered therefrom through a well or other production means drilled into the tar sand deposit.

In situ processes proposed in the literature may be categorized as thermal techniques, including fire flooding and steam flooding, and emulsification drive processes. To be successful, an in situ separation process must accomplish two functions: the viscosity of the crude oil must be reduced and sufficient driving energy to induce movement of the crude oil must be supplied. Emulsification processes frequently also employ steam, plus a basic material such as sodium hydroxide which induces formation of an oil-in-water emulsion having a viscosity substantially lower than the viscosity of the formation petroleum. Thermal processes are restricted to formations having sufficient overburden thickness to permit injection of high pressure fluids. Many tar sand deposits exist in which the overburden thickness is too thin for thermal flooding and too thick for strip mining.

One possible process for recovering bitumen from tar sand deposits which does not require the presence of sufficient overburden thickness to contain high pressures is solvent flooding. Solvent flooding involves injection of a solvent into the tar sand deposit, which solvent dilutes and reduces the viscosity of the bituminous petroleum to render it mobile and recoverable by means of a well as is normally employed in conventional oil recovery operations. Although many solvents including aromatic hydrocarbons such benzene, toluene and xylene, as well as carbon tetrachloride or carbon disulfide, readily dissolve bituminous petroleum these materials are expensive and since huge quantities are required, solvent flooding has not been considered to be economically feasible. Paraffinic hydrocarbons such as propane, butane, pentane, etc. are more readily available and less expensive than those solvents described above, but it has always been uniformly assumed by persons skilled in the art that paraffinic hydrocarbon solvents could not be used in bituminous petroleum because of the danger of precipitating asphaltenes. Indeed, the asphaltic constituents of crude oil are frequently defined as pentane-insoluble materials.

It can be seen from the foregoing that there is a substantial need for a method for recovering viscous petroleum such as bitumen or bituminous petroleum from a tar sand formation by use of readily available inexpensive solvents in a relatively low pressure procedure that can be used in intermediate deep deposits as well as in deep deposits.

SUMMARY OF THE INVENTION

We have discovered, and this constitutes our invention, that viscous petroleum including bitumen may be recovered from viscous petroleum-containing formations including tar sand deposits by injecting into the formation a mixture of hydrocarbon solvents. At least one component of the solvent mixture must be liquid at formation temperatures and pressures and at least one component must be gaseous at formation temperatures and pressures. Hereinafter these solvents will be referred to as gaseous solvents and liquid solvents, although it is to be understood that these terms refer to the phase of the solvent at formation conditions and not at normal conditions. Suitable materials for the gaseous solvents include methane, ethane, propane, butane and pentane, as well as ethylene, propylene and butylene. Carbon dioxide may also be used. Suitable liquid hydrocarbon solvents are hexane, heptane, and higher molecular weight aliphatic hydrocarbons as well as aromatic hydrocarbons such as benzene or toluene. For example, a mixture of propane and hexane is a very desirable combination for recovering bitumen from a subsurface tar sand deposit. A mixture of crude propane and natural gasoline comprises another preferred combination. Production of viscous petroleum or bitumen occurs when the pressure in a portion of the reservoir contacted by the solvent mixture is reduced to a value below the bubble point pressure of the mixture causing the gaseous solvent to break out of solution and displace a solution of liquid solvent and crude oil in a fashion similar to solution gas drive. Production may be taken from a remotely located well or from the same well as was used for injecting the solvent. Surprisingly, the use of paraffinic hydrocarbons such as hexane, etc. in application of this process to tar sand materials does not appear to cause precipitation of asphaltic materials.

DESCRIPTION OF THE PREFERRED EMBODIMENTS

I. The Process

The process of our invention comprises a non-aqueous fluid injection operation necessitating at least one well drilled into and in fluid communication with the petroleum formation. An effective solvent mixture for the particular viscous petroleum or bitumen to which the process is to be applied, is injected via the injection well. The solvent mixture contains at least one component which is gaseous at formation conditions and at least one component which is liquid at formation conditions.

By gaseous, we mean, for the purpose of this application, a material which is gaseous at the pressure and temperature existing in the formation. Similarly, a liquid solvent is liquid at the formation pressure and temperature.

The mixture of the liquid and gaseous hydrocarbon solvent is injected into the formation at a pressure above the bubble point of the mixture, so that substantially all of the solvent mixture is in the liquid phase. It is desirable that the solvent mixture enter the formation as a liquid.

The liquid and gaseous solvents may be mixed on the surface and introduced via one injection string, or two or more injection strings may be used so the liquid and gaseous solvents are injected independently to mix in the formation. Alternatively, separate slugs of the materials may similarly be injected sequentially to mix in the formation. The generally preferred method, however, is to mix the components on the surface and introduce the single liquid phase mixture into the formation by means of a single injection string. The mole ratio of gaseous solvent to liquid solvent may be from 0.10 to 10 and preferably from 0.2 to 2.0.

In applying the process of our invention in a reverse depletion (push-pull) embodiment, wherein the solvent mixture is introduced via the same well as will be used for production of the solvent-petroleum solution, the solvent mixture is injected until the maximum penetration of solvent into the petroleum formation has been achieved. The limiting factor in this step is injection pressure. The solvent mixture injection pressure must be sufficiently high so that the mixture is essentially all liquid, and yet the injection pressure should not be so high that fracturing of the overburden will occur. As a general rule of thumb, overburden fracturing will be avoided if the injection pressure is kept below a value in pounds per square inch numerically equal to the overburden thickness expressed in feet.

As the solvent mixture is injected into the well it spreads radially outward from the injection well and dissolves into viscous petroleum. The volume flow rate will ordinarily be at its maximum value initially and decrease with time if the injection pressure is held constant. Once the injection flow rate has decreased to a comparatively low value, for example in the range of 10% of the initial flow rate, at the upper limit of injection pressure as defined by the overburden thickness rule stated above, the first step is completed. Solvent injection is then terminated and the pressure in the formation adjacent to the well is reduced to permit petroleum to flow into the well. Reduction in pressure below the vapor pressure of the gaseous solvent causes that component to break out of solution. As that portion of the solvent changes from liquid phase to gaseous phase, a large volume increase occurs. This vaporization of the liquefied gaseous hydrocarbon solvent furnishes the driving force necessary to force the solution of bitumen and liquid hydrocarbon solvent to move toward the well and then to the surface of the earth.

It can be seen from the above description of the mechanism thought to be responsible for oil production, why it is necessary that one component of the solvent mixture be gaseous and one liquid at formation conditions, and that the mixture be injected under sufficient pressure to insure that the mixture be essentially all liquid. The driving force responsible for moving viscous petroleum toward the well is realized only when the liquefied gaseous component vaporizes, or changes state from a liquid to a gas, at a point some distance from the well from which production is to be taken. Only if the phase change can create a pressure differential between the point of expansion and the well bore can viscous petroleum be moved in the direction of the well bore. If the solvent is introduced in gaseous form, no vaporization-related volume increases and pressure differential can be created.

It can also be seen that the liquid hydrocarbon component is essential to the proper functioning of our invention. While vaporization of the gaseous solvent furnishes the drive energy to force viscous crude oil to flow, the liquid hydrocarbon component of the solvent mixture remains liquid as pressure is reduced, thereby reducing the viscosity of the viscous crude sufficiently to insure that it will move when the driving energy is applied to it. It can also be appreciated why the reference point for categorizing the solvent as gaseous and liquid must be formation conditions rather than the more usual "normal" conditions, since formation temperature may be higher or lower than 75°F. A small amount of the gaseous solvent may also be dissolved and/or entrained in the bitumen. Very viscous crude which cannot be pumped at ambient temperatures will remain liquid and pumpable at atmospheric pressure because of the presence of solvent therein.

Production of viscous petroleum according to the above described single well reverse depletion (push-pull) embodiment proceeds for a period of time, with production flow rate declining with an increase in the percentage of gaseous hydrocarbon solvent material which has vaporized. After the gas-oil ratio increases to an objectionable value, e.g., around 3000 standard cubic feet per barrel of oil, another cycle of multiple-component solvent injection-pressurization followed by production of a solution of petroleum and liquid hydrocarbon solvent is initiated. Many cycles of injection-production may be utilized, although the efficiency of this process necessarily decreases with time as the zone of petroleum depletion around the well increases, since this zone must be saturated with solvent in order to penetrate sufficiently far into the formation to provide contact with additional formation petroleum.

The recovery efficiency of this process can be increased in the later stages by the following procedure. A quantity of the multi-component solvent combination is injected in liquid form as described above, and then an inert inexpensive fluid such as water or gas is injected into the formation to displace the multi-component solvent away from the well bore and to achieve the desired contact between the solvent and formation petroleum. When the solvent injection phase is completed, pressure reduction again results in vaporization of the gaseous solvent. The vaporizing drive results in movement of viscous petroleum (having the liquid solvent component of the solvent mixture dissolved therein) toward the well. The petroleum-solvent solution forces the inert drive fluid, water or gas, toward the well. The inert fluid is produced first, followed by the petroleum-solvent solution. The inert fluid must be separated from the produced solution of viscous petroleum and solvent, although this is accomplished easily. Separation of water can be accomplished easily in a gravity settling tank, and gas separation will occur spontaneously as the pressure is reduced to atmospheric.

Solvent recovery and recycling will normally be desirable in order to reduce the total inventory of solvent required. The gaseous solvent can be removed from the produced petroleum-solvent solution by reducing the pressure. Much of the gas will have broken out of solution in the production phase, and it is only necessary to provide a closed system to capture this gas for reuse. A compressor will ordinarily be needed to raise the pressure of the gaseous solvent in order to condense this material into a liquid for reinjection into the formation.

Separation of the liquid hydrocarbon solvent may be accomplished by thermal distillation such as by a coke still. If the viscous petroleum is to be subjected to some form of cracking in a processing unit located some distance from the production point, all or a portion of the liquid hydrocarbon solvent may be allowed to remain in the viscous crude to facilitate transportation thereof in a pipeline to the cracking unit. This is especially true in the instance of applying this process to tar sands, since bitumen is much too viscous to pump in its natural form.

When a coke still is used for on site processing of bitumen or other viscous petroleum, substantial amounts of hydrocarbons in the molecular weight range needed for both the gaseous solvent and the liquid solvent are produced. Since the quantity of both types of solvent will increase with time due to the increase in swept volume, it is very advantageous to obtain the desired solvent materials from a coke still.

In another embodiment of the process of our invention, the above described multi-component solvent mixture is used in a multi-well throughput or forward depletion process. In such a process, at least one injection well and at least one production well are used. The multicomponent solvent is injected into the injection well or wells and production is taken from the production well or wells. The injection pressure is similarly high enough to insure that the solvent mixture is essentially all liquid in the production well and the portion of the petroleum formation immediately adjacent thereto. The pressure in the formation adjacent to the production well will normally be near atmospheric pressure, so there will be a positive pressure gradient from the injection well to the production wells, and at some intermediate point in the formation the pressure is below the vapor pressure of the gaseous solvent. The gaseous solvent vaporizes at this point, providing the volume expansion needed to displace petroleum toward the production well.

Solvent recovery and recycling will be accomplished in the same manner as was described in the section dealing with the push-pull recovery embodiment.

Ordinarily a slug of the multi-component solvent is injected into the formation in the throughput process, the slug being followed by an inexpensive drive fluid such as water. From about 5 to about 50 pore volume percent is generally a sufficient volume of solvent. Water injected behind the solvent may contain a minor but effective amount of a viscosity increasing additive such as polyacrylamide or other hydrophilic colloidal polymers, in order to achieve a favorable mobility ratio to insure efficient displacement of the solvent slug by the aqueous drive fluid.

II. The Liquid Solvent

Any material capable of dissolving the viscous petroleum or bituminous petroleum contained in the formation to which the process to be applied, resulting in the formation of a single (liquid) phase solution of solvent and bitumen having a viscosity substantially less than the viscosity of virgin bitumen, which material is a liquid at formation temperature and pressure may be used as the liquid solvent in our process.

Paraffinic hydrocarbons, specifically linear or branched paraffinic hydrocarbons having from 6 to 10 carbon atoms are suitable materials for use as the normally liquid solvent for practicing the process of our invention. For example, hexane, heptane, octane, etc. and mixtures thereof as well as commercial blends such as natural gasoline and naphtha will function as a satisfactory normally liquid solvent in many viscous petroleum-containing formations.

Mononuclear aromatic hydrocarbons, especially benzene, toluene, xylene, or other substituted benzene materials, as well as multiple ring aromatic compounds such as naphthalene, are excellent liquid solvents for use in our process. Economics will generally dictate that only the simpler compounds such as benzene, toluene or xylene, and mixtures thereof, will be used. Mixed aromatic solvents are frequently available from processing streams of refineries which contain a mixture of benzene, toluene, xylene, and substantial amounts of paraffinic materials such as propane or butane. Such materials are economical solvents and frequently the materials are very satisfactory. This can best be determined by simple tests utilizing the solvent under consideration and a sample of crude petroleum from the formation. Mixtures of aromatic hydrocarbons and aliphatic hydrocarbons are excellent liquid solvents for use in our process.

Mixtures of any two or more of the above described compounds may also be used as the normally liquid solvent in the practice of the process of our invention.

III. The Gaseous Solvent

Any solvent which is gaseous at formation temperature and pressure and which can be liquefied at injection conditions may be used as the gaseous solvent in the process of our invention. Low molecular weight paraffinic hydrocarbons such as methane, ethane, propane, butane or pentane, as well as olefinic hydrocarbons such as ethylene, propylene, or butylene are preferred materials. Carbon dioxide is also a very satisfactory gaseous solvent, alone or mixed with gaseous hydrocarbon solvents. Mixtures of any two or more of these gaseous solvents may also be used.

The concentrations of gaseous solvent and the liquid solvent may vary over a fairly broad range and to some extent the preferred concentrations for any particular application will depend on the viscosity of the in place petroleum and other factors. Greater petroleum viscosity reduction is achieved by using larger concentrations of liquid solvent, whereas the greater degree of solution gas drive effect results from using a greater quantity of the gaseous solvent.

IV. Field Example

In order to better understand the process of our invention, the following pilot field example is offered as an illustrative embodiment of our invention; however, it is not meant to be limitative or restrictive thereof.

A tar sand deposit is located at a depth of 250 feet and the thickness of the deposit is 70 feet. Since the ratio of overburden thickness to tar sand deposit thickness is greater than one, the deposit is not economically suitable for strip mining. It is determined that the most attractive method of exploiting this particular reservoir is by means of solvent or miscible flooding. The formation temperature is 55°F.

A commercial grade propane is available at an attractive price in the area, the composition of this material being 75% propane, 5% ethane, 3% methane and 4% butane, 2% pentane and 2% carbon dioxide, with the balance being composed of small quantities of ethylene, propylene, and butylene. This material is essentially all gaseous at formation pressure and temperature, so it is quite suitable for use as the gaseous solvent. Natural gasoline, which is principally composed of $C_6 - C_{10}$ hydrocarbons, is also available from a local refinery at an attractive price. A mixture comprising 25 mole percent crude propane and 75 mole percent natural gasoline is used as the injected multi-component solvent. This combination will be liquid at any pressure above about 40 pounds per square inch at 75°F.

The above described mixture is injected into each of two wells drilled into and completed in the tar sand formation. The injection pressure is 225 pounds per square inch. The criteria for injection pressure are (1) the pressure must be sufficiently high to insure that the multi-component solvent combination enters the formation in the liquid phase, and (2) the pressure must not be so high that lifting or fracturing of the overburden results. As a general rule, overburden fractures can be avoided by maintaining the solvent injection pressure expressed in pounds per square inch below a value numerically equal to the overburden thickness expressed in feet. In this case, the multi-component solvent combination is introduced into the formation at a pressure of 225 pounds per square inch. The liquid solvent combination enters the formation as a liquid. Injection of solvent continues until the flow rate at 225 psi injection pressure declines materially. Solvent injection is then terminated and the pressure in each well bore is reduced to atmospheric pressure. A solution of bitumen and liquid solvent flows from the formation into both well bores and therethrough to the surface of the earth. Reduction in pressure causes the gaseous solvent to vaporize, forcing the solution of bitumen and liquid solvent to move toward the well bores. Presence of the liquid solvent in the bitumen maintains the bitumen in a liquid state with sufficiently low viscosity that it can be pumped. When essentially all of the gaseous solvent has vaporized the driving force is depleted and the production rate declines fairly sharply. Once the production rate has declined to a fairly low, stable value, another cycle of multicomponent solvent injection followed by a production cycle as described above is performed in each well. Numerous cycles of multicomponent solvent injection and production are performed until the recovery efficiency (barrels of bitumen recovered per barrels of solvent used) declines to a very low figure.

After both wells have been exploited by push-pull solvent injection and recovery, the pilot is converted to a throughput forward depletion operation. The wells are 50 feet apart, and the area swept by the injected solvent is determined by reservoir modeling to be 2000 square feet. Since the porosity of the formation is 18 percent, and the vertical conformance is 80%, the swept volume will be (0.18) × (2000) (70) (80) or 20160 cubic feet.

Nitrogen is injected through the formation for two days to establish initial communication. A 10 pore volume percent slug of solvent, or 2000 cubic feet (14,960 gallons) of the same multi-component solvent combination used in the push-pull reverse depletion phase of the program is injected into one well and displaced through the formation by injected water into the injection well. The solvent slug is displaced by the water toward the production well. The injection pressure is maintained at 225 pounds per square inch. Since the formation pressure near the well bore is only slightly above atmospheric pressure, there is necessarily a point between the injection well and production well where the gaseous solvent vaporizes to drive the bitumen toward the production well. Injection of water is continued until the solvent has been essentially fully recovered and water breaks through into the production well. Steam is injected into the formation near the end of the program to aid in recovering solvent from the formation for reuse or resale.

Solvent recovery from produced petroleum and recycling is used in all phases of this project in order to reduce the quantity of solvent required.

V. Experimental Section

In order to demonstrate the operability of the process of our invention, and further to determine the recovery efficiency and magnitude of oil recovery resulting from the application thereof, the following laboratory experimental work was performed.

A cell 17.62 cm. (7 inch) in length and 9.46 cm.$^2$ in cross sectional area was packed with a mined tar sand sample which had been obtained from a strip mining operation in Alberta, Canada. The tar sand material was packed in the cell to a density of 1.89 grams per cubic centimeter. The porosity was determined to be 38.92% and the total pore volume was 64.88 cubic centimeters. The initial oil saturation was 67.32%. Air permeability was 2.90$\mu m^2$ (2937 millidarcies).

Nitrogen gas was injected through the tar sand pack to establish initial communication.

Two runs were made, wherein the solvent used was a mixture comprising 23 mole percent propane and 77 mole percent pentane. Since the experiments were performed at room temperature, pentane is liquid at the temperatures of the experiment and so is used as the liquid solvent. This solvent combination was injected at a pressure of 1481 KPa (215 pounds per square inch). The production end of the cell was at atmospheric pressure and bitumen production was therefore by throughput or forward depletion. If plugging occurred, the pressure on the injection end was reduced to cause back flow or reverse depletion to eliminate the plugging condition.

In run 1, both forward and reverse depletions were used systematically, where as in run 2 only forward depletion was used until cycle 6 and 7 when plugging began to occur. Reverse depletion during cycles 6 and 7 of run 2 cured the plugging problem and also improved the recovery efficiency.

Reproduced below in Table I are the recovery efficiencies for each cycle of runs 1 and 2. Recovery efficiency is a ratio of cumulative volume of produced bitumen to cumulative volume of injected solvent. Table II lists the oil recovery for the two runs, expressed as a percent of the original oil in place.

TABLE I

| RECOVERY EFFICIENCY | | |
|---|---|---|
| | Recovery Efficiency, Cumulative | |
| Cycle | Run 1 | Run 2 |
| 1 | .37 | .09 |
| 2 | .37 | .09 |
| 3 | .34 | .12 |
| 4 | .33 | .14 |
| 5 | .30 | .18 |
| 6 | .26 | .36 |
| 7 | — | .29 |
| 8 | — | .29 |
| 9 | — | .27 |
| 10 | — | .25 |
| 11 | — | .25 |
| 12 | — | .22 |
| 13 | — | .20 |

TABLE II

| OIL RECOVERY | | |
|---|---|---|
| | Run 1 | Run 2 |
| Oil Recovery | 93% | 94.5 |

It can be seen that the recovery efficiency is much better in the case of run 1, using both forward and reverse depletions, than in run 2, using forward depletion only (cycles 1–5). During cycle 6 and 7, reverse depletion was used to cure a plugging problem, and suprisingly, this doubled the recovery efficiency of that cycle. The percent oil recovery in either run is excellent for tar sand materials.

Steam was injected into the well at the conclusion of run 2. Light hydrocarbons (e.g., solvent) were recovered but there was no production of bitumen.

Another test was run using a cell similar to that described above packed with mined tar sand material. Nitrogen was injected to establish initial communication. A slug of liquid propane-pentane (23 mole percent propane, 77 mole percent pentane) was injected into the cell at a pressure of 1481 KPa (215 psia) and forward production was taken by reducing pressure at the production end of the cell to atmospheric pressure. Water at a temperature of 24°C or 75°F was then injected at a rate of 120 gallons per hour until the injection pressure reached 1482 KPa (215 psia), after which the production end pressure was reduced to atmospheric pressure for another cycle of forward production. Whenever plugging occurred, the injection pressure was reduced to cause back flow which alleviated the plugging problem. Seven cycles of solvent injection, depletion, water injection and depletion, were conducted. The data obtained therefrom are given in Table III below.

TABLE III

| ALTERNATE SOLVENT-WATER INJECTION | | | | |
|---|---|---|---|---|
| Cycle | Volume of Injected Hydrocarbon | Volume of Injected Water | Produced Bitumen ($Cm^3$) | Sor After Each Cycle % Voi |
| 1 | 34.95 | 31.87 | 17.2 | 40.26 |
| 2 | 35.22 | 8.60 | 10.0 | 25.05 |
| 3 | 15.48 | 100.55 | 9.2 | 11.07 |
| 4 | 12.45 | 75.17 | 3.4 | 5.90 |
| 5 | 8.68 | 62.00 | 1.0 | 4.38 |
| 6 | 7.56 | 35.00 | 0.4 | 3.77 |
| 7 | 30.71 | 79.63 | 0.1 | 3.62 |

The recovery efficiencies ranged from 49% for cycle 1 to 29% for cycle 7.

Steam was injected into the cell at a rate of 120 gallons per hour. No plugging occurred during steam injection. Light hydrocarbons (solvent) were recovered, but no bitumen. Inert gas injection, e.g., air or nitrogen, may also be used to recover solvent from the formation.

It can be seen that alternating cycles of water injection and multiple-component solvent injection with forward production increased the efficiency of the process.

Thus we have disclosed and demonstrated that viscous petroleum can be recovered from a subterranean formation using a solvent combination comprising at least one solvent which is liquid at formation temperature and pressure and at least one solvent material which is gaseous at formation temperature and pressure, using push-pull, throughput, or a combination process. While our invention has been described in terms of a number of illustrative embodiments, it is not so limited since many variations thereof will be apparent to persons skilled in the related art without departing from the true spirit and scope of our invention. Also, whereas mechanisms have been given to explain the results and benefits of our invention, we do not wish to be limited to any particular mechanism or theory of operation of our process. It is our intention that our invention be restricted and limited only by those restrictions and limitations contained in the appended claims.

We claim:

1. A method for recovering viscous petroleum including bitumen from a subterranean, viscous petroleum-containing, permeable formation including a tar sand deposit, the formation being penetrated by at least one well in fluid communication therewith, comprising:

a. introducing a solvent which is gaseous at formation temperature and pressure, into the formation at a pressure at which the gaseous solvent is essentially all in the liquid phase;

b. introducing a solvent which is liquid at formation temperature and pressure, said solvent being selected from the group consisting of paraffinic hydrocarbons having at least six carbon atoms, mononuclear aromatic hydrocarbons, naphtha, natural gasoline and mixtures thereof, into the formation at a pressure at which the solvent is essentially all in the liquid phase;

c. reducing the pressure in at least a portion of the petroleum formation contacted by the solvents to a value at which the gaseous solvent will be at least partly in the gaseous phase; and d. recovering a solution of the petroleum and the injected liquid solvent from the formation.

2. A method as recited in claim 1 wherein the gaseous solvent and liquid solvent are mixed on the surface and injected into the formation as a liquid mixture.

3. A method as recited in claim 1 wherein the gaseous solvent and liquid solvent are injected simultaneously into the formation via separate flow paths, so the solvents mix in the petroleum formation.

4. A method as recited in claim 1 wherein the gaseous solvent and liquid solvent are injected sequentially to mix in the formation.

5. A method as recited in claim 1 wherein the gaseous solvent is selected from the group consisting of paraffinic hydrocarbons having from one to five carbon atoms, olefinic hydrocarbons having from two to four carbon atoms, carbon dioxide and mixtures thereof.

6. A method as recited in claim 5 wherein the gaseous hydrocarbon solvent is predominantly propane.

7. A method as recited in claim 1 wherein the liquid hydrocarbon is hexane.

8. A method as recited in claim 1 wherein the liquid hydrocarbon is natural gasoline.

9. A method as recited in claim 1 wherein the mole ratio of the gaseous solvent to the liquid solvent is from about 0.10 to about 10.

10. A method as recited in claim 1 wherein the petroleum is produced via the same well as is used for injecting the solvents into the formation.

11. A method as recited in claim 10 wherein more than one cycle of the gaseous and liquid solvent injection and petroleum production are performed.

12. A method as recited in claim 1 wherein the formation is penetrated by at least two spaced apart wells in fluid communication therewith and the solvents are introduced into at least one well and production of petroleum is taken from at least one different, spaced apart well.

13. A method as recited in claim 1 wherein the formation is penetrated by at least two wells in fluid communication therewith and the solvents are injected and reverse petroleum production is accomplished in at least two wells until recovery efficiency drops to a preselected value after which the solvents are introduced into at least one well and forward production taken from at least one remotely located well.

14. A method as recited in claim 1 wherein the formation is penetrated by at least two wells and the solvents are injected into at least one well and forward production taken from at least one remotely located well until plugging in the formation is observed, at which time the pressure is reduced in the injection well to permit reverse production of petroleum therefrom.

15. A method as recited in claim 1 comprising the additional step of introducing an inert fluid including water into the formation after introduction of a predetermined quantity of the solvents thereinto to displace the solvents away from the well.

16. A method as recited in claim 1 wherein at least some of the solvents introduced into the formation are removed from the produced petroleum-solvent solution for re-injection into the formation.

17. A method as recited in claim 1 comprising the additional step of introducing a heated fluid into the formation to recover hydrocarbons therefrom.

18. A method as recited in claim 17 wherein the heated fluid is selected from the group consisting of steam, hot water and mixtures thereof.

19. A method as recited in claim 1 wherein the pressure expressed in pounds per square inch at which the solvents are introduced is numerically less than the depth of the petroleum formation expressed in feet.

20. A process is recited in claim 1 wherein alternating cycles of solvent injection and water injection are performed and forward production is taken from the formation.

21. A method as recited in claim 1 wherein the solvents are recovered after completion of oil recovery operations by injecting an inert gaseous material into the formation.

* * * * *